US007244883B2

(12) United States Patent
Helfrich et al.

(10) Patent No.: US 7,244,883 B2
(45) Date of Patent: Jul. 17, 2007

(54) DRUM CONTAINER

(75) Inventors: Gerard Helfrich, Somerville, MA (US); Steve Lepke, Wakefield, MA (US)

(73) Assignee: First Act Inc., Boston, MA (US)

( * ) Notice: Subject to any disclaimer, the term of this patent is extended or adjusted under 35 U.S.C. 154(b) by 127 days.

(21) Appl. No.: 11/130,681

(22) Filed: May 17, 2005

(65) Prior Publication Data

US 2006/0272474 A1 Dec. 7, 2006

(51) Int. Cl.
*G10D 13/02* (2006.01)

(52) U.S. Cl. ..... 84/413; 84/421

(58) Field of Classification Search ..... 84/413, 84/421, 411 R

See application file for complete search history.

(56) References Cited

U.S. PATENT DOCUMENTS 5,357,838 A * 10/1994 Kurosaki ..... 84/413
6,949,702 B2 * 9/2005 Ortega et al. ..... 84/413
2005/0011338 A1 * 1/2005 Ortega et al. ..... 84/414
2005/0145091 A1 * 7/2005 Okuno ..... 84/413
2005/0241457 A1 * 11/2005 Shimada ..... 84/415
2006/0081115 A1 * 4/2006 Shimada ..... 84/421

* cited by examiner

*Primary Examiner*—Gary F. Paumen
(74) *Attorney, Agent, or Firm*—John E. Toupal; Harold G. Jarcho

(57) ABSTRACT

A drum including a cylindrical shell having an upper edge defining an open top end, and a lower edge defining an open bottom end; a drum skin disposed over the top end; a plurality of lugs mounted on an outer surface of the shell in positions annularly spaced adjacent to the bottom end; and a cover movable between a closed position closing the bottom end and an open position providing access into the shell through the bottom end. Also included is a latch mechanism retained by one or more of the lugs and operable to either retain the cover in the closed position or allow movement of the cover into the open position.

20 Claims, 5 Drawing Sheets

FIG. 7
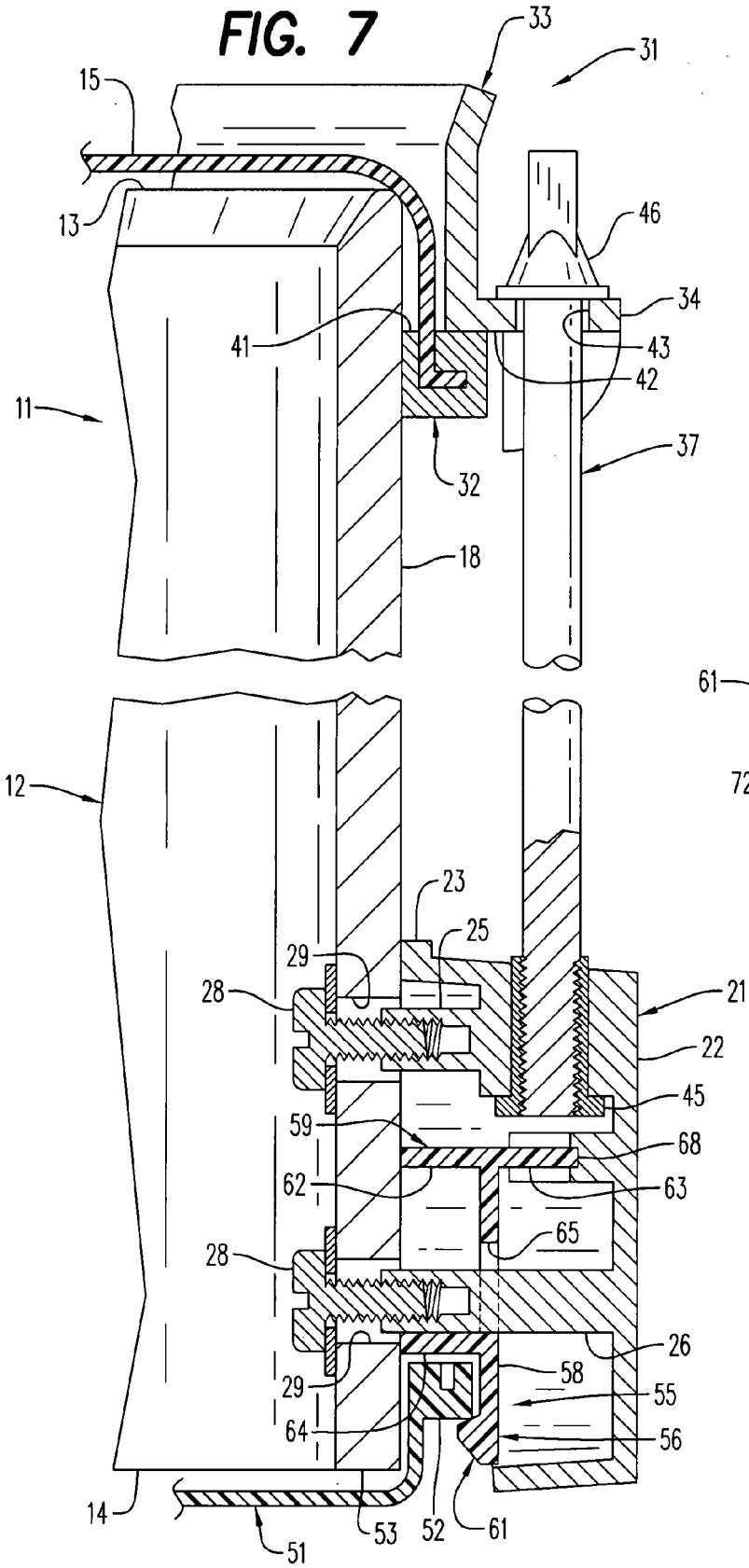
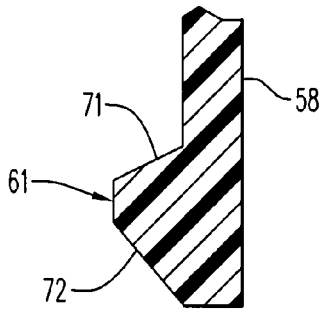
FIG. 7a

DRUM CONTAINER

BACKGROUND OF THE INVENTION

The invention relates generally to a drum and, more particularly, to a drum functioning as both a musical instrument and a container.

Drums are widely used to provide music either individually or in conjunction with other musical instruments. Typical drums consist of a hollow cylindrical shell covered by a skin which is beaten with drum sticks to produce music. However, when not in use the substantial volume within the shell is wasted.

The object of the invention, therefore, is to provide a drum which can function as both a musical instrument and a container.

SUMMARY OF THE INVENTION

The invention is a drum including a cylindrical shell having an upper edge defining an open top end, and a lower edge defining an open bottom end; a drum skin disposed over the top end; a plurality of lugs mounted on an outer surface of the shell in positions annularly spaced adjacent to the bottom end; and a cover movable between a closed position closing the bottom end and an open position providing access into the shell through the bottom end. Also included is a latch mechanism retained by one or more of the lugs and operable to either retain the cover in the closed position or allow movement of the cover into the open position. The latch mechanism facilitates control of the cover to allow use of the drum as a container.

According to certain features of the invention, the cover includes a rim portion extending over the lower edge, and the latch mechanism includes a latch element movable into a latched position engaging the rim to prevent movement of the cover into the open position and movable into a release position allowing movement of the cover into the open position. In addition, the latch element includes a leg portion extending substantially parallel to the shell, and a head portion joined to a bottom end of the leg portion and projecting therefrom toward the shell. These features simplify opening and closing of the cover.

According to another feature of the invention, the latch element is biased in the latched position and forceable into the release position. This feature further simplifies closure of the cover.

According to yet another feature, the head portion defines an upper ramp surface tapered downwardly and inwardly from the leg portion and disposed in the latched position to engage the rim portion. The upper ramp surface facilitates unlatching of the cover.

According to an additional feature, the head portion further defines a lower ramp surface tapered upwardly and inwardly from the leg portion, and the lower surface is disposed to be engaged by the rim during movement of the cover into the closed position. The lower ramp surface facilitates closure of the cover.

According to an important feature of the invention, the leg portion of the latch element is formed of a resilient material biasing the latch element in the latched position and allowing flexible movement into the release position. The resilient latch leg efficiently returns the latch element to its latched position engaging the cover.

According to yet other features, the drum includes at least two of the lugs which include a mounting post secured to the shell, and the leg portion defines an aperture receiving the post. These features simplify the latch mechanism.

DESCRIPTION OF THE DRAWINGS

These and other objects and features of the invention will become more apparent upon a perusal of the following description taken in conjunction with the accompanying drawings wherein:

FIG. 7 is a partial cross-sectional view of the drum shown in FIGS. 1 and 2;

FIG. 7*a* is a detailed view of a head portion of a latch mechanism shown in FIG. 7;

DESCRIPTION OF THE PREFERRED EMBODIMENT

Figure 1:
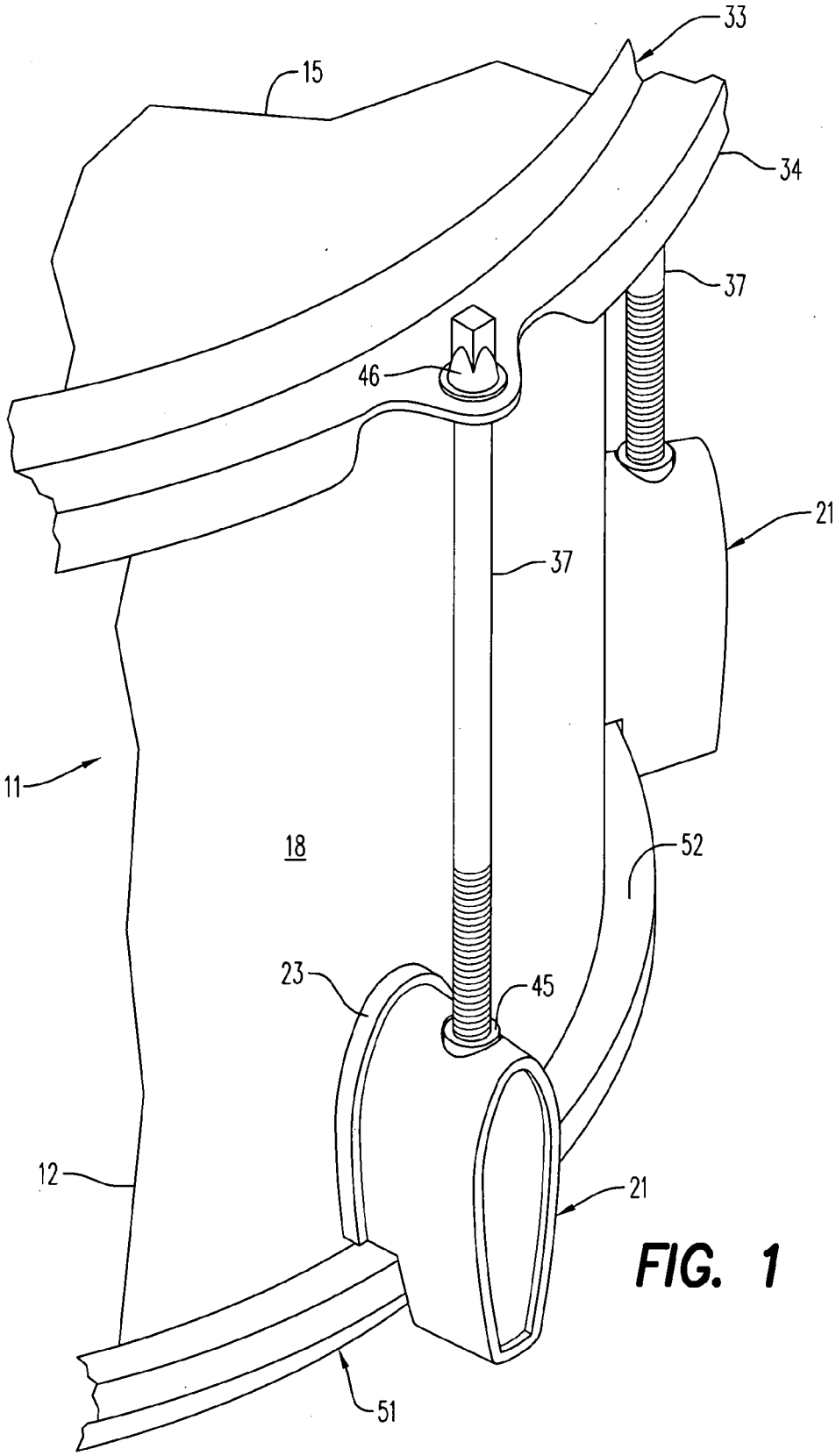
FIG. 1 is a partial side perspective view of a musical drum according to the present invention.
Figure 2:
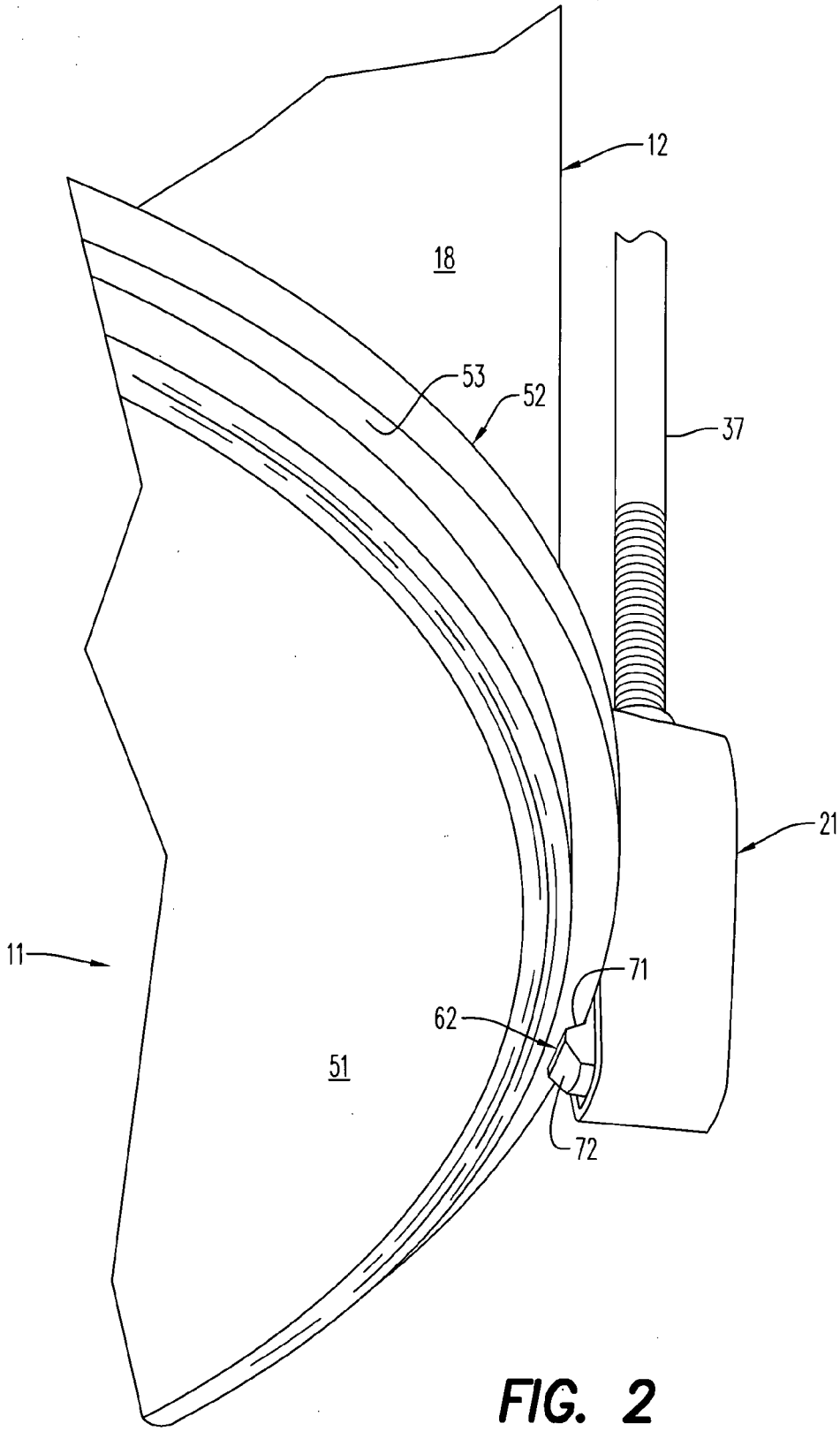
FIG. 2 is a partial bottom perspective view of the drum shown in FIG. 1.
Figure 3:
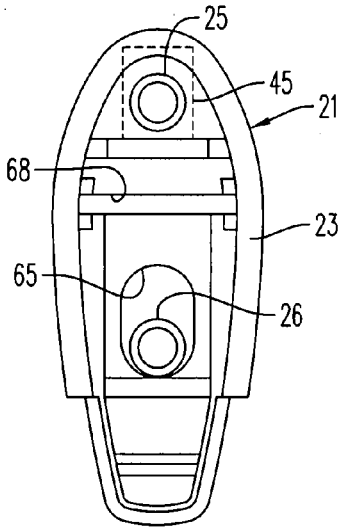
FIG. 3 is an end view of a lug element used in the drum shown in FIGS. 1 and 2.
Figure 4:
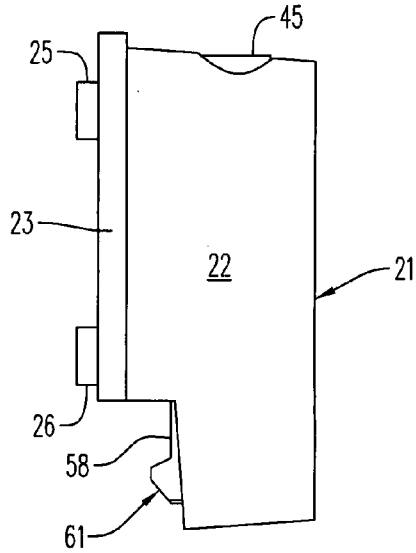
FIG. 4 is a side view of the lug element shown in FIG. 3.
Figure 5:
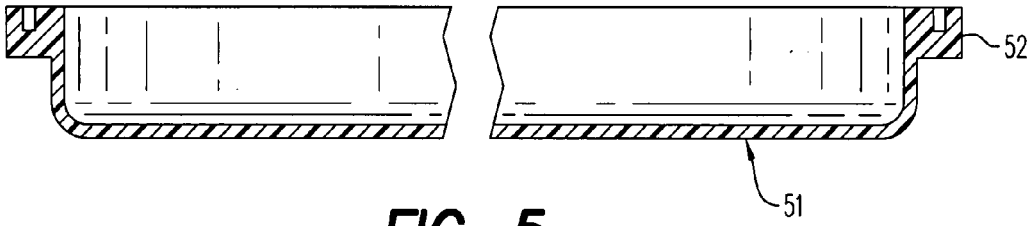
FIG. 5 is a cross-sectional view of a cover element used in the drum shown in FIGS. 1 and 2.

A drum 11 constructed according to the invention is illustrated in FIGS. 1, 2 and 7. Forming the body of the drum 11 is a cylindrical shell 12 having an open top end 13 and an open bottom end 14. A drum skin 15 is disposed over the open top end 13. Mounted on an outer surface 18 of the shell 12 in annularly spaced positions adjacent to the bottom end 14 are a plurality of lugs 21.

Each of the lugs 21 is formed as shown in FIGS. 3–7 with a cup-shaped body 22 having a flange portion 23 for engaging the outer surface 18 of the shell 12 and a pair of vertically spaced apart, internally threaded posts 25, 26. Retaining each lug 21 against the shell surface 18 are bolts 28 which extend through openings 29 in the shell and engage the internally threaded posts 25, 26.

Associated with each lug 21 is an assembly 31 for tensioning the drum skin 15 as shown most clearly in FIG. 7. Included in the assembly 31 are an anchor ring 32, a tensioning ring 33 having an outwardly projecting flange portion 34, and a tensioning rod 37. The anchor ring 32 is molded to an outer edge of the drum skin 15 and has an inner surface 39, engages the outer surface 18 of the shell 12, and an upper surface 41 engaged by a bottom edge 42 of the tensioning ring 33. Extending through a hole 43 in the flange portion 34 is an upper end of the tensioning rod 37 while a lower end thereof engages a threaded insert 45 in the lug 21. A nut 46 on the upper end of the rod 37 engages an upper surface of the flange portion 34.

The open bottom end 14 of the shell 12 can be closed by a circular cover 51 having a rim portion 52 projecting over a bottom edge 53 of the shell. As described hereinafter, the cover 51 can be moved between a closed position covering the open end 14 of the shell 12 and an open position providing access into the shell.

Attainment of a desired open or closed position is controlled by a latch mechanism 55 retained in each of the lugs 21. The latch mechanism 55 is shown most clearly in FIG. 6. Forming the latch mechanism 55 is a body element 56 molded with a flexible, resilient material.

Figure 6:
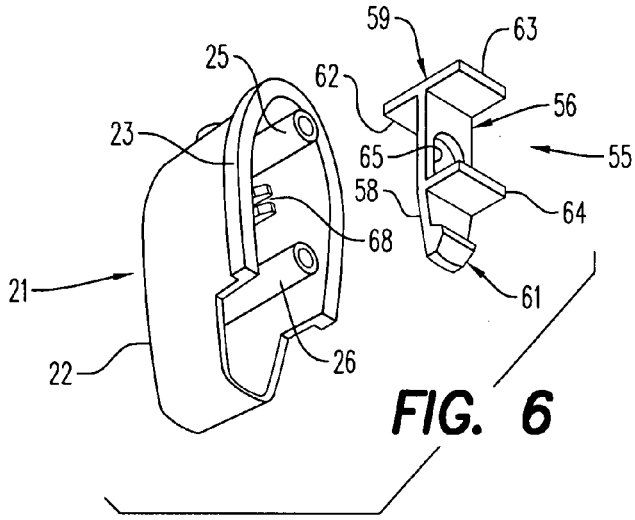
FIG. 6 is a detailed exploded view of a latch mechanism and lug element used in the drum shown in FIGS. 1 and 2.

The latch body 56 includes a leg portion 58 straddled by a base portion 59 and a head portion 61 projecting from a bottom end of the leg portion toward the shell 12. As shown in FIG. 6, the base portion 59 consists of arms 62, 63 extending in opposite directions from an upper end of the leg portion 58, while another arm 64 projects transversely from a mid point of the leg portion 58. Formed in the leg portion 58 directly above the arm 64 in an aperture 65. The body 56 is retained within the lug 21 as shown in FIG. 7 with the arms 62 and 64 engaging the outer shell surface 18, the arm 63 retained within a slot 68 formed in the lug 21, and the aperture 65 receiving the mounting post 26. Shown most clearly in FIG. 7*a*, the head portion 61 defines an upper ramp surface 71 tapered downwardly and inwardly from the leg portion 58 and a lower ramp surface 72 tapered upwardly and inwardly from the leg portion.

Figure 8:
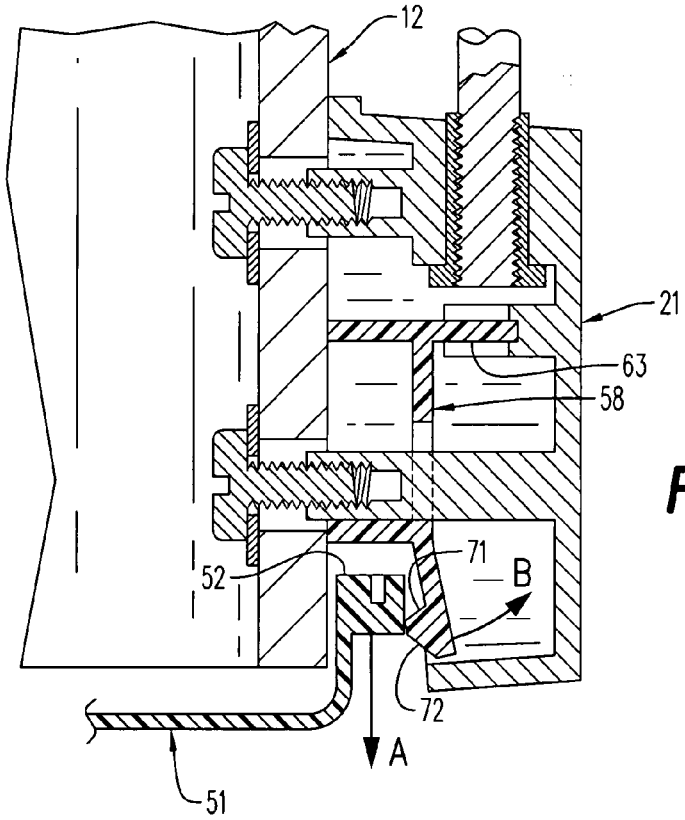
FIG. 8 is a partial cross-sectional view illustrating removal of a cover element from the drum shown in FIGS. 1 and 2.
Figure 9:
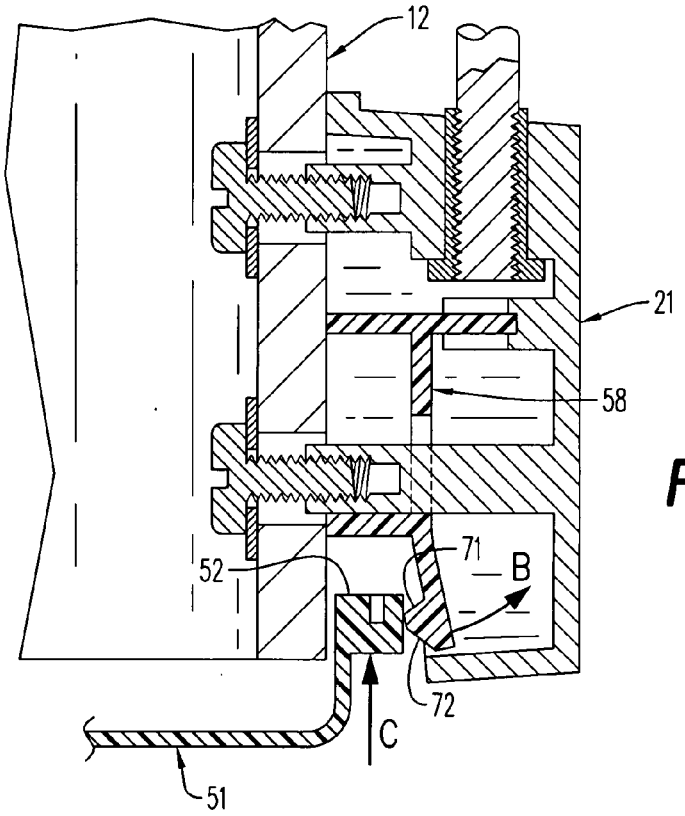
FIG. 9 is a partial cross-sectional view illustrating mounting of a cover element on the drum shown in FIGS. 1 and 2.

Operation of the bottom cover 51 between open and closed positions is best described in conjunction with FIGS. 8 and 9. To remove the cover 51 and provide access to the interior of the shell 12, a downward force A (FIG. 8) is applied to the cover 51 causing the rim portion 52 to exert outward force B on the upper ramp surface 71 and pivotally flexing the head 61 outwardly to allow passage of the rim portion and removal of the cover 51. Return of the cover 51 to its closed position is accomplished by applying an upward force C (FIG. 9) causing the rim portion 52 to exert outward force B on the lower ramp surface 72 and resultant outward pivotal movement of the head 61 to allow passage of the rim 52. Upon movement of the rim 52 by the head 61, the resilient leg portion 58 springs inwardly into a latched position (FIG. 7) retaining the cover in a closed position. Thus, the cover 51 can be removed and the volume within the shell 12 used to store items such as, for example, other musical instruments which are retained by closing the cover. Before subsequent use of the drum 11 for providing music, the cover 51 again can be removed to allow removal of the shell's contents.

Obviously, many modifications and variations of the present invention are possible in light of the above teachings. It is to be understood, therefore, that the invention can be practiced otherwise than as specifically described.

What is claimed is:

1. A drum comprising:

a cylindrical shell having an upper edge defining an open top end, and a lower edge defining an open bottom end;

a drum skin disposed over said top end;

retainer assembly retaining said drum skin over said top end;

a plurality of lugs mounted on an outer surface of said shell in positions annularly spaced adjacent to said bottom end;

a cover movable between a closed position closing said bottom end and an open position providing access into said shell through said bottom end; and a latch mechanism retained by one or more of said lugs and operable to either retain said cover in said closed position or allow movement of said cover into said open position.

2. A drum according to claim 1 wherein said cover includes a rim portion extending over said lower edge, and said latch mechanism includes a latch element movable into a latched position engaging said rim to prevent movement of said cover into said open position and movable into a release position allowing movement of said cover into said open position.

3. A drum according to claim 2 wherein said latch element comprises a leg portion extending substantially parallel to said shell, and a head portion joined to a bottom end of said leg portion and projecting therefrom toward said shell.

4. A drum according to claim 3 wherein said latch element is biased in said latched position and forceable into said release position.

5. A drum according to claim 4 wherein said head portion defines an upper ramp surface tapered downwardly and inwardly from said leg portion, and said upper surface is disposed in said latched position to engage said rim portion.

6. A drum according to claim 5 wherein said head portion further defines a lower ramp surface tapered upwardly and inwardly from said leg portion, and said lower surface is disposed to be engaged by said rim during movement of said cover into said closed position.

7. A drum according to claim 4 wherein said leg portion of said latch element is formed of a resilient material biasing said latch element in said latched position and allowing flexible movement into said release position.

8. A drum according to claim 7 wherein said head portion defines an upper ramp surface tapered downwardly and inwardly from said leg portion, and said upper surface is disposed in said latch position to engage said rim portion.

9. A drum according to claim 8 wherein said head portion further defines a lower ramp surface tapered upwardly and inwardly from said leg portion, and said lower surface is disposed to be engaged by said rim during movement of said cover into said closed position.

10. A drum according to claim 7 wherein said drum comprises two or more of said lugs which each include a mounting post secured to said shell, and said leg portion defines an aperture receiving said post.

11. A drum according to claim 1 wherein said drum further comprises a tension assembly for maintaining tension on said drum skin, said tension assembly including a tensioning ring and a tensioning rod extending between each of said lugs and said tensioning ring.

12. A drum according to claim 11 wherein said cover includes a rim portion extending over said lower edge, and said latch mechanism includes a latch element movable into a latched position engaging said rim to prevent movement of said cover into said open position and movable into a release position allowing movement of said cover into said open position.

13. A drum according to claim 12 wherein said latch element comprises a leg portion extending substantially parallel to said shell, and a head portion joined to a bottom end of said leg portion and projecting therefrom toward said shell.

14. A drum according to claim 13 wherein said latch element is biased in said latched position and forceable into said release positions.

15. A drum according to claim 14 wherein said head portion defines an upper ramp surface tapered downwardly and inwardly from said leg portion, and said upper surface is disposed in said latched position to engage said rim portion.

16. A drum according to claim 15 wherein said head portion further defines a lower ramp surface tapered upwardly and inwardly from said leg portion, and said lower surface is disposed to be engaged by said rim during movement of said cover into said closed position.

17. A drum according to claim 14 wherein said leg portion of said latch element is formed of a resilient material allowing flexible movement from said biased latched position to said release position.

18. A drum according to claim 17 wherein said latch element is biased in said latched position and forceable into said release position.

19. A drum according to claim 18 wherein said head portion defines an upper ramp surface tapered downwardly and inwardly from said leg portion, and said upper surface is disposed in said latched position to engage said rim portion.

20. A drum according to claim 17 wherein said head portion further defines a lower ramp surface tapered upwardly and inwardly from said leg portion, and said lower surface is disposed to be engaged by said rim during movement of said cover into said closed position.

* * * * *